United States Patent [19]

Yamashiro et al.

[11] Patent Number: 4,904,560

[45] Date of Patent: Feb. 27, 1990

[54] SUSPENSION POLYMERIZATION PROCESS FOR PRODUCING ELECTROPHOTOGRAPHIC TONERS

[75] Inventors: Jiro Yamashiro, Kobe; Takashi Miki, Tatsuno, both of Japan

[73] Assignee: Bando Chemical Industries, Ltd., Kobe, Japan

[21] Appl. No.: 212,651

[22] Filed: Jun. 28, 1988

[30] Foreign Application Priority Data

| | | | |
|---|---|---|---|
| Jun. 29, 1987 | [JP] | Japan | 62-161540 |
| Jul. 30, 1987 | [JP] | Japan | 62-191269 |
| Mar. 25, 1988 | [JP] | Japan | 63-072871 |
| Apr. 6, 1988 | [JP] | Japan | 63-086133 |

[51] Int. Cl.[4] ..... G03G 9/08

[52] U.S. Cl. ..... 430/137; 430/107; 430/904

[58] Field of Search ..... 430/137, 107, 904

[56] References Cited

U.S. PATENT DOCUMENTS 4,507,378 3/1985 Wada et al. ..... 430/137

*Primary Examiner*—J. David Welsh

*Attorney, Agent, or Firm*—Wenderoth, Lind & Ponack

[57] ABSTRACT

A process for producing toners for use in electrophotography which comprises: stirring a mixture of a radical polymerizable liquid monomer and carbon black in the presence of a peroxide polymerization initiator, thereby to disperse the carbon black uniformly and minutely in the monomer; adding an azobisnitrile polymerization initiator to the resultant monomer composition; suspension polymerizing the monomer in an aqueous medium; and recovering and drying the resultant spherical polymer particles.

In a preferred process, the suspension polymerization is carried out in an aqueous medium which contains polyvinyl alcohol as a suspending agent, and after the polymerization, the polyvinyl alcohol remaining on the polymer particles is saponified or nitrated to produce a toner with a higher quality.

18 Claims, 2 Drawing Sheets

SUSPENSION POLYMERIZATION PROCESS FOR PRODUCING ELECTROPHOTOGRAPHIC TONERS

This invention relates to a process for producing toners for use in electrophotography.

Toners or developing agents in the form of finely divided particles for developing electrostatic latent images in electrophotography have been heretofore produced by a so-called crushing process, in which a colorant such as carbon black, an electric charge controlling agent such as a certain dyestuff, and an anti-offset agent such as a wax are mixed and kneaded together with a melted thermoplastic resin, thereby to disperse them in the resin, cooling, crushing and pulverizing the resultant solid mixture to powders of desired particle sizes.

In this process, it is necessary that the resin used be brittle so that a mixture of the resin and the addtives as mentioned above be readily crushed. However, when a resin used is too brittle, the resultant toner is excessively finely divided during the use in an electrophotographic apparatus, and contaminates the inside of the apparatus or forming fog on developed positive images. On the other hand, when a resin used is readily melted, the resultant toner is apt to coalesce together and is undesirably reduced in fluidity, but also there takes place filming on an photoconductive body to deteriorate the quality of positive images.

It is also necessary that individual toner particles have colorants and charge controlling agents equally and finely dispersed therein, and be capable of being equally electrified so as to produce high quality positive images. However, according to this prior crushing process, colorants and charge controlling agents are unequally divided among individual toner particles with varied particle sizes.

Therefore, a method has been proposed to produce toner particles directly by suspension or emulsion polymerization of a polymerizable monomer which contains colorants therein such as carbon black. However, as well known, carbon black usually inhibits radical polymerization of monomers, and the inhibition is especially remarkable when a peroxide is used as a radical polymerization initiator. More specifically, the polymerization of monomers in the presence of carbon black provides polymers in a low polymerization rate, so that the resultant polymers readily aggregate together and cannot be utilized as toner particles. When a large amount of an initiator is used to increase polymerization rate, the resultant polymer has a small molecular weight and hence fails to fulfill anti-offset requirements.

An improved process has been therefore proposed. In that process, carbon black is coated with a silane coupling agent in water, recovered and dispersed in a radical polymerizable monomer in the presence of a peroxide polymerization initiator as a dispersion agent. Then the resultant monomer containing carbon black therein is suspended in water, and then polymerized, as disclosed in Japanese Patent Laid-Open No. 53-17735. According to this process, the monomer is freed from the inhibition of polymerization since the carbon black is coated with a silane coupling agent. However, since carbon black is essentially hydrophobic, the treating of carbon black with a silane coupling agent in water and drying thereafter are not easy to carry out. Moreover these additional steps raise production costs of toners.

It is also necessary in the production of toner particles by suspension polymerization of monomers that carbon black be dispersed finely and uniformly in monomers to produce high quality toners. When carbon black is unequally or nonuniformly dispersed in monomers, the carbon black is divided unequally among the resultant individual toner particles. Such toner particles are remarkably different in triboelectricity from each other, and therefore produce a toner image accompanied by fog or a toner image with an insufficient darkness.

Therefore, a method to disperse carbon black uniformly in monomers has been proposed in Japanese Patent Laid-Open No. 56-116044. In that method, monomers are heated in the presence of carbon black so that there takes place graft polymerization of the monomer to the carbon black. This method provides carbon black with an improved dispersibility in monomers, but has disadvantages in that the graft polymerization needs a long time reaction at high temperatures. Moreover, the carbon black still retains polymerization inhibition effect in suspension polymerization especially when a peroxide initiator is used.

The use of carbon black which has specified properties has also been proposed, for example, in Japanese Patent Laid-Open No. 57-181553 and No. 61-22353, however, this prior method is disadvantage in that carbon black used is limited, and further the dispersion is still found to be insufficient.

As above described, it is difficult to disperse carbon black finely and uniformly in radical polymerizable monomers, or it is necessary to adopt very complicated methods to do so.

Furthermore, the conventional production of toner particles by such suspension polymerization as has been proposed has been found to be accompanied by a problem that derives from suspending agents dissolved in an aqueous medium in the suspension polymerization. Namely, in the prior process, monomers are suspension polymerized in an aqueous medium which contains a suspending agent such as polyvinyl alcohol. At least some portions of the suspending agent remains inevitably on the surface of the resultant polymer particles even after repeated washing, and therefore the particles are very sensitive to humidity. Thus such toners are low in triborlectricity under high humidity, and are apt to produce noncharged or reversely charged toners during the use, to provide a toner image with undesired fog or a toner image with an insufficient darkness.

It is therefore an object of the invention to provide a process for producing toners for use in electrophotography which has carbon black, and when desired together with a charge controlling agent, divided equally and finely among individual particles of a high molecular weight, in a high polymerization rate by suspension polymerization of radical polymerizable monomers.

It is another object of the invention to provide a process for producing toners which are freed from undesired effects deriving from polyvinyl alcohol used as a suspending agent in suspension polymerization, and hence toners which produce high quality toner images irrespectively of change of ambient conditions.

The process for producing toners for use in electrophotography of the invention comprises: stirring a mixture of a radical polymerizable liquid monomer and carbon black in the presence of a peroxide polymerization initiator, thereby to disperse the carbon black minutely and uniformly in the monomer; adding an azobisnitrile polymerization initiator to the resulting monomer composition; suspension polymerizing the monomer in an aqueous medium; and recovering and drying the resultant spherical polymer particles.

A preferred process of the invention comprises:

(a) a step of stirring a mixture of a radical polymerizable liquid monomer and carbon black in the presence of a perioxide polymerization initiator, thereby to disperse the carbon black minutely and uniformly in the monomer;

(b) a step of mixing the resultant mixture with a charge controlling agent powder and stirring the mixturte, thereby to disperse the powder minutely and uniformly in the monomer;

(c) adding an azobisnitrile polymerization initiator to the resultant monomer composition, suspending the composition in aqueous medium, and polymerizing the monomer; and (d) recovering the resultant spherical polymer particles and drying the same.

Any radical polymerizable monomer which is known as usable for the production of toner by suspension polymerization is usable in the invention. Therefore, such monomers include, for example, styrene, substituted styrenes such as o-methylstyrene, m-methylstyrene, p-methylstyrene or p-chlorostyrene; vinyl esters such as vinyl acetate or vinyl propionate; acrylic acid esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, phenyl acrylate or $\alpha$-chloromethyl acrylate; methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, $\alpha$-chloromethyl methacrylate, dimethylaminoethyl methacrylate, diethylaminoethyl methacrylate or glycidyl methacrylate; unsaturated nitriles such as acrylonitrile or methacrylonitrile; $\alpha,\beta$-unsaturated carboxylic acids such as acrylic acid or methacrylic acid; and vinylpyridines such as 2-vinylpyridine or 4-vinylpyridine. These monomers are used singly or as a mixture of two or more. Among these, however, styrene or a mixture of styrene and acrylic or methacrylic acid esters are preferred.

A polyfunctional monomer may be used together with the monomers as above mentioned to improve fixation and anti-offset properties of toners. There may be mentioned as such a polyfunctional monomer, for example, divinylbenzene and ethylene glycol dimethacrylate. A variety of polyfunctional monomers are already known in the art, and any one of these may be used, if desired. The polyfunctional monomer may be used normally in amounts of not more than about 1% by weight based on the radical polymerizable monomer. When the polyfunctional monomer is used in excessive amounts, the resultant polymer particles are too high in melting points to fix sufficiently on a support.

The peroxide polymerization initiator used in the invention includes, for instance, benzoyl peroxide, lauroyl peroxide, o-chlorobenzoyl peroxide and o-methoxy benzoyl peroxide, and especially lauroyl peroxide is preferred.

According to the invention, a radical polymerization monomer and carbon black are stirred usually for several hours in the presence of a peroxide polymerization initiator as above mentioned. This step disperses carbon black uniformly in the monomer in particle size of not more than submicrons. The dispersion step may be carried out at room temperatures, but if desired, at elevated temperatures, for example, at about 50°-80° C. to accelerate the dispersion of carbon black in the monomer.

In the dispersion step, carbon black is used in amounts of about 2-10 parts by weight in relation to 100 parts by weight of the radical polymerizable monomer. The carbon black used is not specifically limited, however, a carbon black which has a high pH value and a small specific surface area is preferred, since such a carbon black can be more minutely and uniformly dispersed in the monomer in the presence of a smaller amount of the peroxide polymerization initiator. Moreover such a carbon black has substantially no inhibition effect in the step of suspension polymerization of the monomer using an azobisnitrile polymerization initiator.

In the dispersion step of carbon black in the monomer, the peroxide polymerization initiator is used usually in amounts of about 10-50 parts, preferably of about 10-40 parts by weight, in relation to 100 parts by weight of carbon black used. The use of the peroxide polymerization initiator in amounts of not more than about 10 parts by weight in relation to 100 parts by weight of carbon black used, fails to disperse carbon black minutely and uniformly in the monomer, whereas the use of the peroxide polymerization initiator in amounts of more than about 50 parts by weight in relation to 100 parts by weight of carbon black used, the decomposition fragments of the initiator remain in the resultant toner particles, and the toner undesirably smells bad when the toner is heated, melted and fixed on a support during an electrophotographic process.

The use of an azobisnitrile polymerization initiator, such as azobisisobutyronitrile or azobisdimethylvaleronitrile, in place of a peroxide polymerization initiator in the step of the carbon black dispersion, fails to uniformly and minutely disperse carbon black in the monomer, but carbon black coaleses together, and most of the carbon black used are dispersed as large particles in the monomer. Furthermore, the monomer in part polymerizes in the presence of an azobisnitrile polymerization initiator, to increase the viscosity of the mixture of the monomer and the carbon black. This adversely affects the preparation of suspension of fine droplets of the monomer composition in an aqueous medium.

In the step of the dispersion of carbon black in the monomer in the presence of a peroxide polymerization initiator, the carbon black and the peroxide may be added together to the monomer and then the carbon black may be dispersed in the monomer by use of, for instance, a ball mill, or the carbon black may be in advance dispersed preliminarily in the monomer and then a peroxide may be dissolved thereinto, followed by stirring, for example, in an autoclave.

Figure 1:
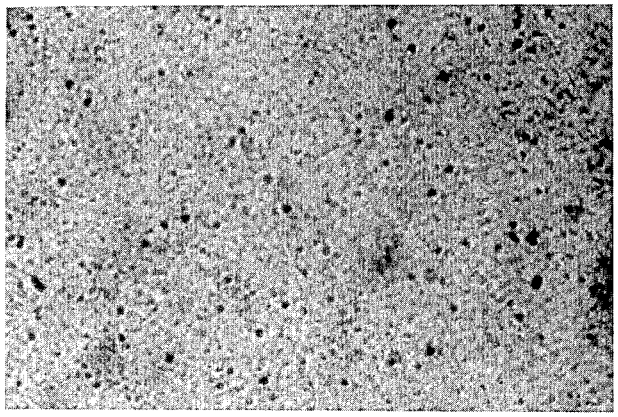
FIG. 1 is a microphotograph (x 600) showing the dispersion of carbon black according to the invention.

According to the invention, a charge controlling agent powder may be incorporated into the monomer. The charge controlling agent may be first added to the monomer and dispersed therein by use of, for example, a ball mill, and then carbon black may be dispersed in the manner as set forth before.

However, it is preferred that carbon black is first dispersed in the monomer in the manner as described hereinbefore, and then a charge controlling agent be dispersed in the monomer. More specifically, after the dispersion of carbon black in the monomer, a charge controlling agent is added to the monomer together with a dispersing agent soluble in the monomer, and the mixture is stirred for, for example, about 50–200 hours, in a ball mill, thereby to pulverize the agent and disperse it finely and uniformly in particle size of not more than about 0.5 μm, preferably of not more than about 0.3 μm in the monomer. This dispersion step may also be carried out at elevated temperatures such as at about 50°–80° C. to accelerate the dispersion.

The dispersing agent used may be either a low molecular weight substance or a high molecular weight substance. The low molecular weight substance includes, for example, surfactants, silane coupling agents, titanium coupling agents and oligomeric organic materials which contain therein isocyanate or epoxy groups.

More specifically, there may be mentioned as surfactants, for example, anionic surfactants such as fatty acid salts, alkylsulfuric acid esters, alkylbenzenesulfonic acid salts, alkylnaphthalenesulfonic acid salts, dialkylsulfosuccinic acid esters, alkylphosphoric acid esters, naphthalenesulfonic acid-formalin condensates or polyoxyethylene alkylsulfuric acid salts; nonionic surfactants such as polyoxyethylene alkyl ether, polyoxyethylene alkyl phenol ether, polyoxyethylene fatty acid esters, polyoxyethylene sorbitan fatty acid esters, polyoxyethylene alkyl amines, glycerine fatty acid esters or oxyethylene-oxypropylene block polymers; and cationic surfactants such as alkyl amines or quaternary ammonium salts.

The silane coupling agent may be exemplified by γ-chloropropyltrimethoxysilane, vinyltrichlorosilane, vinyltrimethoxysilane, vinyltriethoxysilane, γ-methacryloxypropyltrimethoxysilane, γ-glycydoxypropyltrimethoxysilane, γ-mercaptopropyltrimethoxysilane, γ-aminopropyltrimethoxysilane, γ-ureidopropyltriethoxysilane, 3,3,4,4,5,5,6,6,6-nonafluororhexyltrichlorosilane and 3,3,4,4,5,5,6,6,6-nonafluorohexylmethyldichlorosilane. Further, there may be mentioned as reactive silanes, for example, methyltrimethoxysilane, phenyltrimethoxysilane, methylphenyldimethoxysilane and diphenyldimethoxysilane.

The titanium coupling agent may be exemplified by isopropyltriisostearoyl titanate, isopropyltris(dioctylpyroohosphate) titanate, isopropyltris(N-aminoethylaminoethyl) titanate, tetraoctylbis(ditridecylphosphite) titanate, tetra-2,2-diallyloxymethyl-l-butyl bis(ditridecyl)phosphite titanate, bis(dioctylpyrophoshate)oxyacetate titanate, bis(dioctylpyrophosphate)ethylene titanate, isopropyltrioctanoyl titanate, isopropyldimethacrylisostearoyl titanate, isopropyltridecylbenzenesulfonyl titanate, isopropylisostearoyldiacryl titanate, isopropyltri(dioctylphosphate) titanate, isopropyltricumylphenyl titanate and tetraisopropylbis(dioctylphosphite)titanate.

On the other hand, the high molecular weight dispersing agent preferably includes homopolymers or copolymers which have functional groups therein, such as carboxyls, sulfones, hydroxyls, halogens, epoxys, cyanos, nitriles, butyrals, esters, carbonyls or aminos.

More specifically, the high molecular weight polymeric dispersing agent includes, for instance, vinyl (co)polymers, rubber polymers, cellulosic polymers and cross-linkable polymers. The vinyl (co)polymers includes, for example, styrene-acrylic acid copolymers, stryrene-dimethylaminoethyl methacrylate copolymers, styrene-methacrylic acid copolymers, styrene-2-hydroxyethyl methacrylate copolymers, styrene-acrylonitrile copolymers, styrene-glycidyl methacrylate copolymers, methacrylate-acrylic acid copolymers, methyl methacrylate-dimethylaminoethyl methacrylate copolymers, methyl methacrylate-methacrylic acid copolymers, methyl methacrylate-2-hydroxyethyl methacrylate copolymers, methyl methacrylate-acrylonitrile copolymers, methyl methacrylateglycidyl methacrylate copolymers, vinyl chloride-vinyl acetate copolymers, vinyl chloride-vinyl acetate-vinyl alcohol copolymers, polyvinyl butyral resins, vinylidene chlorideacrylonitrile copolymers, acrylonitrile-butyl acrylate-2-hydroxyethyl methacrylate copolymers, ethylene-vinyl acetate copolymers, polyvinyl acetate resins and partially sulfonated polystyrene resins. The rubber polymer includes, for example, acrylonitrile-butadiene copolymers, and the cellulosic polymer includes, for example, nitrocellulose and acetyl cellulose. The cross-linkable polymer includes, for instance, epoxy resins, phenoxy resins and urethane resins. These polymers may be used singly or as a mixture of two or more.

Most preferably, there is used, as a dispersing agent, a polymer having functional groups therein which have a strong interaction with a charge controlling agent used. By way of example, when an electron accepting dyes such as metallized azo dyes or an electron accepting organic complex is used as a negatively triboelectrified charge controlling agent, ethylene-vinyl acetate copolymers are preferably used as a dispersing agent.

A variety of charge controlling agent are already known in the art, and in the process of the invention, either positive or negative charge controlling agent may be used. However, as will be described hereinafter, when the polymer particles obtained are treated with a nitrating agent, a negative charge controlling agent is preferred since the nitration increases negative triboelectricty of the particles.

The charge controlling agent is used usually in amounts of about 0.05–10 parts, preferably of about 0.1–5 parts by weight, in relation to 100 parts by weight of the monomer used.

In the dispersion of the charge controlling agent in the monomer, the amount of the dispersing agent used varies depending on the particle size of the charge controlling agent used, however, it is usually in amounts of about 1–100 parts, preferably of about 10–50 parts by weight, in relation to 100 parts by weight of the charge controlling agent used. When excessive amounts of the dispersing agent are used, the resultant mixture which contains the monomer, carbon black and charge controlling agent is too high, and the finely pulverizing of the charge controlling agent is not attained. When the dispersing agent is used only in small amounts, the charge controlling agent is not uniformly dispersed in the monomer.

Similarly to the dispersion of carbon black in the monomer, the charge controlling agent may be in advance preliminarily dispersed in the monomer using, for example, a ball mill, and then the dispersing agent may be dissolved in the monomer, followed by stirring, or the dispersing agent may be added to the monomer together with the charge controlling agent and stired using, for example, a ball mill.

Some of the charge controlling agents have been found to inhibit undesired polymerization of monomers in an aqueous medium in suspension polymerization, which will be described in more detail hereinafter. Such a charge controlling agent is exemplified by "Spiron Black TRH" (by Hodogaya Kagaku Kogyo K.K., Japan), a chromium containing azo dye. Therefore, this dye is preferably used in the invention both as a charge controlling agent and as a polymerization inhibitor in an aqueous medium in suspension polymerization. However, if desired, the dye may be dispersed in monomers only as a polymerization inhibitor in an aqueous medium in suspension polymerization, apart from its original function as a charge controlling agent. In this case, other charge controlling agents may be dispersed together with the dye in monomers.

The charge controlling agent may be an inorganic powder, an organic powder or an organic polymer powder. The inorganic charge controlling agent includes, for example, nitrides, carbides, oxides, sulfates, carbonates, titanic acid salts, phosphoric acid salts, silicates and hexafluorosilicates. More specifically, there may be mentioned as inorganic charge controlling agent, for example, nitrides such as boron nitride; carbides such as titanium carbide, tungsten carbide, zirconium carbide, boron carbide or silicon carbide; oxides such as silica, chromium oxide, cerium oxide, zirconium oxide, titanium oxide, magnesium oxide, aluminum oxide, copper oxide, nickel oxide or zinc oxide; strontium sulfate, barium sulfate, calcium sulfate, aluminum sulfate, magnesium sulfate or copper sulfate; carbonates such as calcium carbonate or magnesium carbonate; phosphoric acid salts such as calcium phosphate; silicates of such as zirconium, copper, cobalt, nickel, magnesium, calcium, strontium, barium, aluminum or zinc; hexafluorosilicates of such as sodium, calcium, strontium, barium, zinc or aluminum. Further examples include emery, alundum, garnet, corundum, lime, tripolyphosphate, halloycite, bentonite, molybdenum acid chelate pigments and acidic terra.

These inorganic charge controlling agent may be coated with silane or titanium coupling agents. The coupling agent used is selected depending upon the triboelectricity of toners required. When a negatively charged toner is to be produced, a coupling agent which is readily negatively charged is used, for example, dichlorosilanes, and when a positively charged toner is to be produced, a coupling agent which is readily positively charged is used, for example, aminosilanes. Some examples of these coupling agents are described hereinbefore.

The organic charge controlling agent usable in the invention may be any known in the art, and includes metallized dyes and pigments, and carboxylic acid metal salts, especially fatty acid metal salts. However, there may be mentioned as an example of a positive charge controlling agent preferably usable in the invention, an electron donating dye, such as a nigrosine dye represented by:

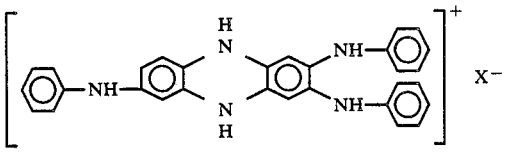

wherein $X^-$ is an anion species. On the other hand, there may be mentioned as an example of a negative charge controlling agent preferably usable in the invention, an electron accepting dye, such as a chromium containing dye represented by:

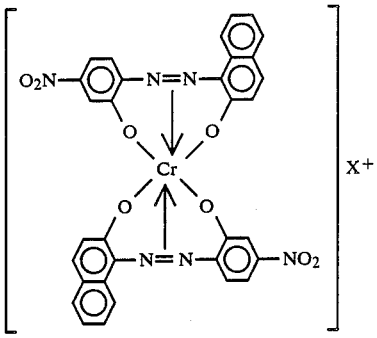

wherein X= is a cation species, and "Spiron Black TRH" (by Hodogaya Kagaku Kogyo K.K., Japan) represented by:

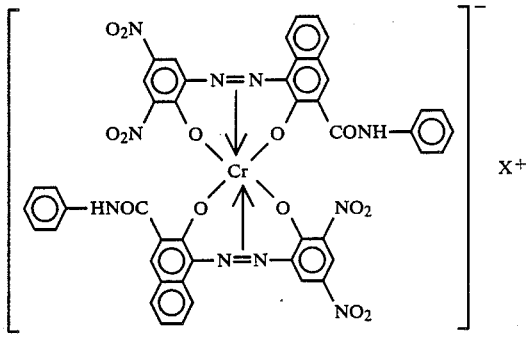

wherein X= is a cation species.

There may be further mentioned as examples of positive charge controlling agents, alkoxylamines, alkylamides and quaternary ammonium salts, and there may be mentioned as examples of negative charge controlling agents, sulfonyl amines of copper phthalocyanines, oil black, naphthenic acid metal salts and zinc stearate, resinous acid soaps.

A variety of organic polymers are also known as usable as a charge controlling agent, and a polymer is suitably selected depending upon the triboelectricity of toners required. When a negatively charged toner is to be produced, a polymer which is readily negatively charged is used, for example, a polymer or a copolymer of a monomer having an aromatic nucleus as an electron attracting group, such as styrene or derivatives thereof. Therefore, such polymers include, for example, polystyrene, styrene-butyl acrylate copolymer, styrene-2-ethylhexyl acrylate copolymer or styrenebutyl methacrylate copolymer. Polymers containing therein halogen atoms such as chlorine or fluorine are also usable as negative charge controlling agents, and they may be exemplified by polyvinyl chloride. When a positively charged toner is to be produced, a polymer which is readily positively charged is used, for example, polymethyl methacrylate, polybutyl methacrylate or polyamides. These polymeric charge controlling agents preferably have glass transition temperatures of not less than about 70° C.

In the process of the invention, carbon black and preferably a charge controlling agent, are dispersed in the monomer as hereinbefore described, and if necessary additional amounts of the monomer are further added to the dispersion, and then an azobisnitrile polymerization initiator is added to the dispersion, to form a monomer composition. The azobisnitrile polymerization initiator usable in the invention includes, for example, azobisdimethylvaleronitrile and azobisdimethylisobutyronitrile, however, azobisdimethylvaleronitrile is especially preferred since it is highly soluble in the monomer.

The monomer composition in the form of a dispersion thus containing an azobisnitrile polymerization initiator is then dispersed in an aqueous medium as small droplets by use of, for example, a homozinizer, and is heated so that suspension polymerization proceeds to produce spherical polymer particles.

When no azobisnitrile polymerization initiator is added anew to the monomer composition, substantially no suspension polymerization occurs even under heating, since substantially all the peroxide polymerization initiator which has been added to the monomer in the stage of the dispersion of carbon black in the monomer are decomposed during the dispersion, and therefore it is necessary that a polymerization initiator be anew added to the monomer in the stage of suspension polymerization. The polymerization initiator added in the stage of polymerization should be an azobisnitrile polymerization initiator, not a peroxide. The addition of a peroxide polymerization initiator is substantially useless since the initiator fails to polymerize the monomer, or if polymerization takes place, the resultant polymer has a very low molecular weight, and has no sufficient anti-offset properties.

The azobisnitrile polymerization initiator is used usually in amounts of about 1–10 parts, preferably of about 2–5 parts by weight, in relation to 100 parts by weight of the monomer used. When the amount is less than about 1 part by weight in relation to 100 parts by weight of the monomer used, the polymerization proceeds only very slowly, and it is substantially impossible to polymerize the monomer in a high polymerization rate, while when the amount is more than about 100 parts by weight in relation to 100 parts by weight of the monomer used, the resultant polymer is low in molecular weight, and is insufficient in anti-offset properties.

As previously described, the mixture of the monomer, carbon black, an azobisnitrile polymerization initiator, and optionally a charge controlling agent are mixed with water, and severely stirred by use of, for example, a homozinizer, to provide an aqueous dispersion of the monomer composition in the aqueous medium.

It is preferred that the water as a dispersion medium in suspension polymerization contains a suspending agent, such as water-soluble polymers, e.g., polyvinyl alcohol, polyethylene oxide, ethylene oxide-propylene oxide copolymer, homopolymers or copolymers of acrylic acid, or salts of these; or water-insoluble inorganic salts, e.g., calcium carbonate, hydrophilic silica or calcium tertiary phosphate. In addition, the water may contain water-soluble inorganic salts such as sodium chloride, sodium sulfate or aluminum sulfate to inhibit the polymerization of the monomer in an aqueous phase.

The suspension is then stirred at temperatures usually of about 40°–95° C., preferably of about 50°–90° C., to carry out suspension polymerization of the monomer. After the polymerization, the resultant spherical polymer particles are separated from the suspension, washed usually with water, and dried. If necessary, the particles are classified to desired particle sizes.

The thus obtained particles, as they are, may be used as a toner in electrophotography. However, when polyvinyl alcohol is used as a suspending agent in the suspension polymerization, at least some of the polyvinyl alcohol remains on the surface of the particles, and it adversely affects the properties of the resultant toner. For instance, the particles are sensitive especially to change of humidity on account of hydrophilicity of the polyvinyl alcohol, and is reduced in triboelectric charge generated in an electrophotographic process under high humidity circumstances. This causes production of nonelectrified or reversely electrified particles when being used as a toner.

Therefore, a further process for producing a toner for use in electrophotography is provided according to the invention.

The process of the invention comprises: forming a mixture of a radical polymerizable monomer and carbon black dispersed therein; suspension polymerizing the monomer in an aqueous medium which contains polyvinyl alcohol as a suspending agent; saponifying the polyvinyl alcohol remaining on the resultant spherical polymer particles; and recovering and drying the spherical polymer particles.

A preferred process of the invention comprises:

(a) a step of stirring a mixture of a radical polymerizable liquid monomer and carbon black in the presence of a peroxide polymerization initiator, thereby to disperse the carbon black minutely and uniformly in the monomer;

(b) a step of mixing the resultant mixture with a charge controlling agent powder and stirring the mixturte, thereby to disperse the powder minutely and uniformly in the monomer;

(c) adding an azobisnitrile polymerization initiator to the resultant monomer composition, suspending the composition in aqueous medium which contains polyvinyl alcohol as a suspending agent, and polymerizing the monomer;

(d) saponifying the polyvinyl alcohol remaining on the resultant spherical polymer particles; and (e) recovering the particles and drying the same.

Further according to the invention, the polyvinyl alcohol may be nitrated in place of being saponified.

Thus, a preferred process of the invention comprises:

(a) a step of stirring a mixture of a radical polymerizable liquid monomer and carbon black in the presence of a peroxide polymerization initiator, thereby to disperse the carbon black minutely and uniformly in the monomer;

(b) a step of mixing the resultant mixture with a charge controlling agent powder and stirring the mixturte, thereby to disperse the powder minutely and uniformly in the monomer;

(c) adding an azobisnitrile polymerization initiator to the resultant monomer composition, suspending the composition in aqueous medium which contains polyvinyl alcohol as a suspending agent and polymerizing the monomer;

(d) nitrating the polyvinyl alcohol remaining on the resultant spherical polymer particles with an aqueous nitrating agent; and (e) recovering the particles and drying the same.

The dispersion of carbon black and a charge controlling agent in the monomer, and the suspension polymerization of monomers containing the above have been described hereinbefore.

The polyvinyl alcohol used as a suspending agent has an average polymerization degree usually of about 300–3000 and a saponification degree of about 80–99 mole %, and is contained in an aqueous medium in amounts usually of about 0.1–5% by weight based on the medium used. This manner of use of the polyvinyl alcohol as a suspending agent is already known.

The saponification of the polyvinyl alcohol will be first described.

In one method, the saponification of the polyvinyl alcohol on the particles may be carried out by adding a saponification agent to the suspension after the suspension polymerization. In another method, the particles are separated from the suspension after the suspension polymerization, and the particles may be treated with a saponification agent.

The saponification is carried out using an alkali or an acid. When an alkali is used, the amount thereof may be between about an equivalent to and about 1000 times as much as an equivalent to the vinyl acetate contained in the polyvinyl alcohol used as the suspending agent in the suspension polymerization, and preferably in amounts of about 5–50 times an equivalent to the vinyl acetate in the polyvinyl alcohol used in the suspension polymerization. However, the amount is not critical in the process, and an amount less than an equivalent may be satisfactorily used to substantially saponify the polyvinyl alcohol remaining on the particles. If necessary, a minimum amount of the saponification agent required may be determined by a simple experiment well-known in the chemistry of polyvinyl alcohol. The alkali used as a saponification agent includes, for example, sodium hydroxide and potassium hydroxide.

In a preferred embodiment, the saponification may be carried out as follows. After the polymerization, an aqueous solution of a lower aliphatic alcohol, such as methanol, ethanol, propanol, among which methanol is most preferred, in amounts of about 1–50% by volume, preferably of about 5–30% by volume, containing an alkali, is added to a suspension containing the polymer particles, and the mixture is stirred at temperatures of about 30°–70° C. for about 1–10 hours, although these reaction conditions are not critical.

The use of a lower aliphatic alcohol, such as methanol, in the alkali saponification of the polyvinyl alcohol is advantageous in that the alcohol raises wettability of the polymer particles to water, thereby to carry out the saponification in a short period of time. Further, methanol in particular is used, the vinyl acetate unit in the polyvinyl alcohol reacts with methanol to produce methyl acetate by an ester exchange reaction, so that the saponification reaction proceeds rapidly.

After the saponification in this manner, for example, the polymer particles are separated, washed with water or preferably with an aqueous alcohol solution as previously mentioned, and then washed with an aqueous solution or an aqueous alcohol solution which contains an acid such as hydrochloric acid to neutralize the alkali used, and finally further washed with water or an aqueous alcohol solution. As the washing is preferred an aqueous alcohol solution, and especially an aqueous methanol solution which contains methanol in amounts of about 1–50%, preferably of about 5–30% by volume. The washing to neutralize the alkali contains an acid usually in amounts of equivalent at most to the amount of the alkali used in the saponification.

The saponification of the polyvinyl alcohol on the polymer particles may be alternatively carried out using an acid. By way of example, an aqueous solution or preferably an aqueous alcohol solution as before described of an acid such as sulfuric acid or hydrochloric acid is added to a suspension of the polymer particles, stirred under heating, neutralized with an alkali, washed with water, and dried, to provide a toner.

Now turning to nitration or nitric acid ester formation of the polyvinyl alcohol remaining on the polymer particles, in one method, the nitration of the polyvinyl alcohol may be carried out by adding an aqueous nitrating agent to a suspension after suspension polymerization. In another method, the particles are separated from the suspension after the suspension polymerization, and the particles may be treated with an aqueous nitrating agent.

In a preferred method, the resultant polymer particles are washed with water or an aqueous alcohol solution, preferably an water/methanol mixture (from 99/1 to 50/50 in volume ratios), and then are stirred at temperatures of about 0°–30° C. for about 1–10 hours in the presence of an aqueous nitrating agent. The aqueous nitrating agent used in the invention includes an aqueous solution of nitric acid, a mixture of nitric acid and sulfuric acid, and a mixture of nitric acid and anhydrous acetic acid. The nitrating agent is usually so prepared as to contain the acids in total in amounts of about 1–70% by weight, and is used usually in amounts of about 5–100 parts by weight in relation to 1 part of the polymer particles.

After the nitration, the reaction mixture is poured into water, the polymer particles are separated and washed with water or an aqueous alcohol solution, preferably an water/methanol mixture (preferably from 99/1 to 50/50 in volume ratios), dried, and if necessary crushed or pulverized, to provide a toner.

The nitration of the polyvinyl alcohol remaining on the polymer particles after the suspension polymerization increases negative triboelectricity of the particles, and thus prevents the production of reversely charged or noncharged toners in an electrophotographic process.

The polymer particles thus prepared according to the invention have a fine and uniform particle size, and a high fluidity, so that the particles, as they are, may be used as a toner in an electrophotographic process, however, the particles may be admixed with a fluidizing agent such as hydrophobic silica so that they have a higher fluidity. The fluidizing agent may be used usually in amounts of about 0.05–1 parts, preferably of about 0.1–0.5 parts by weight, in relation to 100 parts by weight of the polymer particles.

The toner according to the invention may be used either as a two-component toner, a nonmagnetic one-component toner, or a magnetic one-component toner. In the production of a magnetic toner according to the invention, magnetic powders are preferably mixed with and dispersed in the monomer with a suitable means such as a ball mill, and then the monomer is mixed with carbon black and optionally with a charge controlling agent, followed by suspension polymerization of the monomer in the manner as hereinbefore described. In the production of a magnetic toner, magnetic materials such as triiron tetroxide, ferrite or magnetite are used in amounts of about 30–300 parts, preferably of about 30–100 parts by weight, in relation to 100 parts by weight of the monomer.

When the polymer particles are used as a toner in a two-component developing manner, the particles are mixed with a carrier material well known in the art to form a two-component toner. The carrier material usable includes, for example, an iron powder, a ferrite powder, a powder mixture of resins and magnetic substances, and a magnetite powder. In a two-component toner, the polymer particles are used usually in amounts of about 2–20% by weight, preferably of about 5–10% by weight of the toner.

As set forth above, according to the invention, since carbon black is first dispersed as finely divided particles of submicrons in particle size uniformly in monomers by stirring together with monomers in the presence of a peroxide polymerization initiator, the thus prepared monomer composition can be suspended as very small droplets in an aqueous medium under a high shearing force while retaining the fine dispersion of the carbon black. Namely, the individual droplets of monomers contain finely divided carbon black equally dispersed therein. Further according to the invention, the monomer is then polymerized with an azobisnitrile polymerization initiator with no substantial inhibition accompanied, to provide high molecular weight polymer particles in high polymerization rates.

As further aspects of the invention, the polyvinyl alcohol remaining on the particles are saponified after the suspension polymerization, so that the polymers are insensitive to humidity and stable in triboelectricity, and thus provide high quality toner images irrespectively of ambient circumstances. Alternatively, the nitration of the polyvinyl alcohol increases negative triboelectricity of the particles, to prevent the production of reversely charged or noncharged particles in an electrophotographic process, to provide high quality toner images.

The invention will now be described with reference to examples, however, the invention is not limited thereto.

EXAMPLE 1

An amount of 5 parts by weight of carbon black "Diablack" (tradename) #2350 (volatile matters 9.0%, pH 2.0, particle size 15 mμ, by Mitsubishi Kasei Kogyo K.K., Japan) was added to and mixed with 50 parts by weight of styrene in a ball mill for 30 minutes to preliminarily disperse the carbon black in the monomer. Then an amount of 2 parts by weight of lauroyl peroxide was added to the mixture, and the resultant mixture was placed in an autoclave and stirred therein for 1 hour. The carbon black was found not to sediment in the dispersion after this dispersion procedure.

An amount of 1 part by weight of an ethylene-vinyl acetate copolymer "Soablene CH" (tradename, by Nippon Gosei Kagaku Kogyo K.K., Japan) as a suspending agent and 2.5 parts by weight of a negative charge controlling agent "Spiron Black TRH" (tradename, by Hodogaya Kagaku Kogyo K.K., Japan) were added to the dispersion, and stirred with a ball mill for 100 hours. After this dispersion procedure, the charge controlling agent powder was found of about 0.3 μm in particle size, and was found not to sediment in the dispersion.

To the resultant dispersion were then added 40 parts by weight of styrene, 10 parts by weight of 2-ethylhexyl acrylate and 0.3 parts by weight of divinylbenzene to form a monomer composition as shown in Table 1, and further 3 parts by weight of azobisdimethylvaleronitrile and 3 parts by weight of polypropylene wax as an anti-offset agent.

The monomer composition was dispersed in 500 ml of water containing polyvinyl alcohol (about 1700 in a polymerization degree and 88 mole % in a saponification degree) in amounts of 1% by weight and sodium chloride in concentrations of 0.1 N, in a volume ratio of the monomer composition to the water of 1.5/5.0 under stirring at 15,000 rpm by use of an effective mixer.

The resultant aqueous dispersion was stirred at 70° C. for 5 hours, and then at 90° C. for another 1 hour. The resultant spherical polymer particles were centrifuged, washed with water several times, and dried under reduced pressures, to provide a toner.

The polymerization rate of the monomer, and melt viscosity, triboelectric charge and average particle size of the polymer particles obtained, and electrostatic copying performance when the toner was applied to an electrostatic copying machine Model 1102Z (by Sanyo Denki K.K., Japan) at a temperature of 25° C. and a relative humidity of 35% are shown in Table 1.

The melt viscosity of the polymer was measured with a capillary rheometer (by Toyo Seiki K.K., Japan) at 150° C. with $\gamma$ of 1000 second$^{-1}$. The triboelectric charge of the particles was measured by a blow-off method with a mixture of the particles and iron carrier powder with the former in amounts of 6% by weight based on the mixture.

EXAMPLE 2

An amount of 5 parts by weight of carbon black "Asahi Thermal Black" (tradename, volatile matters 1.0%, pH 8.6, particle size 72 mμ, by Asahi Carbon K.K., Japan) was mixed with 50 parts by weight of styrene in a ball mill for 30 minutes to preliminarily disperse the carbon black in the monomer.

Then 1 part by weight of lauroyl peroxide was added to the mixture, and the mixture was placed in an autoclave and stirred therein for 1 hour. The carbon black was found not to sediment in the dispersion after this dispersion procedure.

Thereafter in the same manner as in Example 1, a toner was prepared. The results of the same measurements with the toner as in Example 1 are shown in Table 1.

EXAMPLE 3

Carbon black "Diablack" #52 (volatile matters 0.8%, pH 8.0, particle size 27 mμ, by Mitsubishi Kasei Kogyo K.K., Japan) was used in place of "Diablack" #2350, and otherwise in the same manner as in Example 2, a toner was obtained.

The results of the same measurements with the toner as in Example 1 are shown in Table 1. The surface hydrophobicity and amounts of reversely charged particles, degrees of fog formed on toner images and darkness of toner images, the measurement of which will be described in Example 6, are also shown in Table 3.

COMPARATIVE EXAMPLE 1

An amount of 8 parts by weight of lauroyl peroxide was used in place of azobisdimethylvaleronitrile in the stage of polymerization of the monomer, and otherwise in the same manner as in Example 1, suspension polymerization was carried out, however, the polymerization rate was found small.

Further, since the polymer particles aggregated together, the measurements of triboelectric charge, average particle size and electrostatic copying performance were impossible.

When no polymerization initiator was used at the stage of polymerization, no substantial polymerization was found to take place.

COMPARATIVE EXAMPLE 2

An amount of 5 parts by weight of "Asahi Thermal Black" was dispersed in the monomer in the same manner as in Example 1, and 9 parts by weight of lauroyl peroxide were used in the stage of suspension polymerization, and otherwise in the same manner as in Example 1, a toner was prepared.

The results of the same measurements with the toner as in Example 1 are shown in Table 1.

It was found that polymer particles were obtained in a relatively high polymerization rate, but the particles were inferior in anti-offset properties.

COMPARATIVE EXAMPLE 3

An amount of 5 parts by weight of carbon black "Diablack" #2350 was mixed with about 100 parts by weight of a monomer composition as shown in Table 1, and the mixture was stirred in a ball bill for 30 minutes, to disperse the carbon black in the monomer composition. Then an amount of 3 parts by weight of azobisdimethylveleronitrile, 2.5 parts by weight of a negative charge controlling agent "Spiron Black TRH" and 3 parts by weight of polypropylene wax were added to the mixture.

The thus obtained monomer mixture was dispersed in the same aqueous medium in the same manner as in Example 1, and the resultant aqueous dispersion was stirred at 70° C. for 5 hours, and then at 90° C. for another 1 hour. The resultant polymer particles were centrifuged, washed with water several times, and dried under reduced pressures, to provide a toner.

The results of the same measurements with the toner as in Example 1 are shown in Table 1. There were obtained polymer particles in a high polymerization rate similarly to the polymerization in Example 1, but the particles were found to provide a small darkness positive images having remarkable fog thereon.

TABLE 1

| | Examples | | | Comparative Examples | | | |
|---|---|---|---|---|---|---|---|
| | 1 | 2 | 3 | 1 | 2 | 3 | 4 |
| Monomer composition | | | | | | | |
| Monomer | | | | | | | |
| Styrene | 90 | 90 | 90 | 90 | 90 | 90 | 90 |
| 2-Ethylhexyl acrylate | 10 | 10 | 10 | 10 | 10 | 10 | 10 |
| Divinylbenzene | 0.3 | 0.3 | 0.3 | 0.3 | 0.3 | 0.3 | 0.3 |
| Carbon black | | | | | | | |
| Diablack #2350 | 5 | — | — | 5 | — | 5 | — |
| Asahi Thermal Black | — | 5 | — | — | 5 | — | — |
| Diablack #52 | — | — | 5 | — | — | — | 5 |
| Charge controlling agent | 2.5 | 2.5 | 2.5 | 2.5 | 2.5 | 2.5 | 2.5 |
| Polypropylene wax | 3 | 3 | 3 | 3 | 3 | 3 | 3 |
| Polymerization initiator | | | | | | | |
| Lauroyl peroxide | — | — | — | 8 | 9 | — | — |
| Azobisdimethylvaleronitrile | 3 | 3 | 3 | — | — | 3 | 3 |
| Polymerization rate (%) | 100 | 100 | 100 | 70 | 95 | 100 | 100 |
| Properties of toner | | | | | | | |
| Melt viscosity ($\times 10^4$ poise) | 1.6 | 2.0 | 1.9 | 0.15 | 0.7 | 1.7 | 1.9 |
| Electric charge ($\mu$C/g) | −20 | −28 | −17.2 | * | −25 | −7 | −17.1 |
| Average particle size ($\mu$m) | 11.3 | 12.1 | 12.3 | * | 11.8 | 12.0 | 12.0 |
| Copying performance | | | | | | | |
| Anti-offset properties | Good | Excellent | Excellent | * | Bad | Good | Good |

Notes:
*Measurements were impossible on account of aggregation of toners.

COMPARATIVE EXAMPLE 4

The same charge controlling agent as in Example 1 was dispersed in the monomer by stirring in a ball mill for 5 hours together with styrene containing carbon black dispersed therein, and otherwise in the same manner as in Example 1, a toner was obtained. The properties of the toner are shown in Table 1. The surface hydrophobicity and amounts of reversely charged particles, degrees of fog formed on toner images and darkness of toner images, the measurement of which will be described in Example 6, are also shown in Table 3.

EXAMPLE 4

An amount of 15 parts by weight of carbon black shown in Table 2 and lauroyl peroxide in varied amounts as shown in Table 2 were mixed with 100 parts by weight of styrene. The resultant mixture was stirred with a ball mill for 30 minutes to preliminarily disperse the carbon black in the monomer. Then the mixture was placed in an autoclave and stirred therein at temperatures of 70° C. for 1 hour. The dispersion of the carbon black in the monomer was examined with an optical microscope. The results are shown in Table 2 together with the results obtained when no peroxide was used.

FIG. 1 is a microphotograph (x 600) showing the dispersion of "Diablack" #52 when lauroyl peroxide was used in amounts of 20% by weight based on the carbon black.

TABLE 2

| | Diablack | | | | | Asahi Thermal |
|---|---|---|---|---|---|---|
| | #2350 | #1000 | #850 | MA-100 | #52 | Black |
| Average particle size (m$\mu$) | 15 | 18 | 18 | 22 | 27 | 72 |
| Specific surface area ($m^2$/g) | 260 | 200 | 200 | 134 | 113 | 24 |
| Volatile matters (%) | 9.0 | 3.0 | 1.5 | 1.5 | 0.8 | 1.0 |
| pH | 2.0 | 3.0 | 8.0 | 3.5 | 8.0 | 8.6 |
| Amount of lauroyl peroxide* | Dispersion** | | | | | |

TABLE 2-continued

| | Diablack | | | | | Asahi Thermal |
|---|---|---|---|---|---|---|
| | #2350 | #1000 | #850 | MA-100 | #52 | Black |
| 0 | D | D | D | D | D | D |
| 10 | C | B | B | B | B | B |
| 20 | B | A | A | A | A | A |
| 40 | A | A | A | A | A | A |

Figure 2:
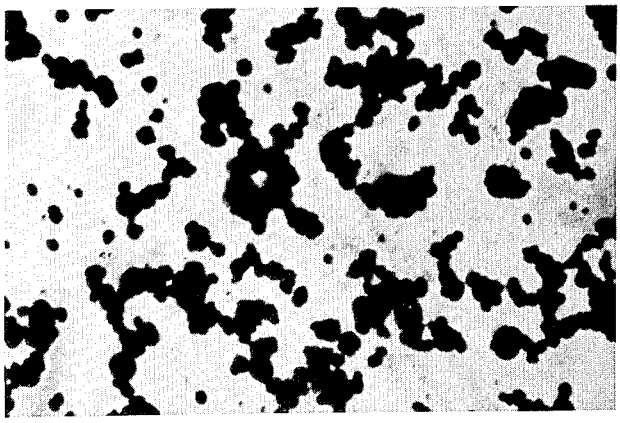
FIGS. 2 and 3 are microphotograph (x 600) showing the dispersion of carbon black as comparative examples.

Notes:
*% by weight based on carbon black
**A: Excellent; B: Good; C: Fairly good; D: Bad As clearly seen, the carbon black was dispersed minutely and uniformly in the monomer. For comparison, FIG. 2 is a microphotograph (x 600) showing the dispersion of the same carbon black as above when no lauroyl peroxide was used. As clearly seen, the carbon black was found to aggregate to large particles in the monomer.

COMPARATIVE EXAMPLE 5

An amount of 15 parts by weight of carbon black "Diablack" #52 and azobisisobutyronitrile in amounts of 13.7% by weight based on the carbon black were mixed with 100 parts by weight of styrene, and the resultant mixture was stirred with a ball mill for 30 minutes to preliminarily disperse the carbon black in the monomer. Then the mixture was placed in an autoclave and stirred therein at 70° C. for 1 hour.

Figure 3:
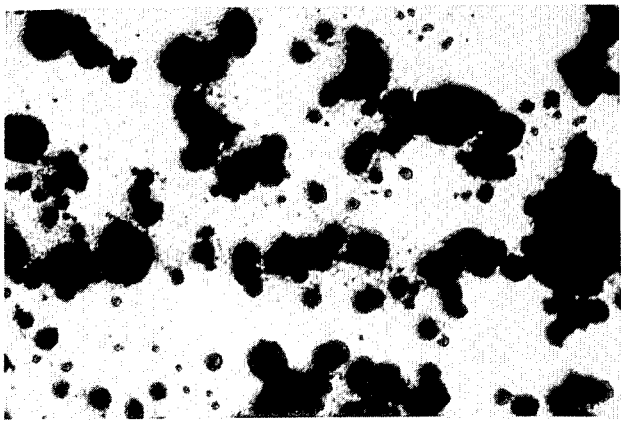

The dispersion of the carbon black in the monomer was shown in a microphotograph (x 600) of FIG. 3. The carbon black was found to aggregate to large particles in the monomer.

EXAMPLE 5

Figure 4:
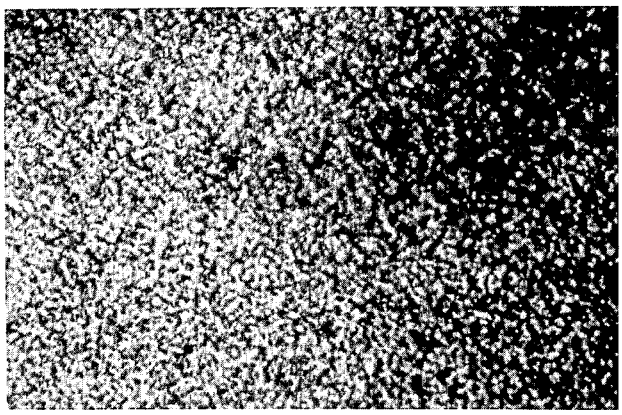
FIG. 4 is also a microphotograph (x 600) showing the dispersion of carbon black according to the invention.

An amount of 15 parts by weight of carbon black "Diablack" #52 and benzoyl peroxide in amounts of 24.3% by weight based on the carbon black were mixed with 100 parts by weight of styrene, and the resultant mixture was stirred with a ball mill for 30 minutes to preliminarily disperse the carbon black in the monomer. Then the mixture was placed in an autoclave and stirred therein at temperatures of 70° C. for 1 hour. The dispersion of the carbon black in the monomer was shown in a microphotograph (x 600) of FIG. 4. The carbon black was found to be dispersed minutely and uniformly in the monomer.

EXAMPLE 6

In the same manner as in Example 3, suspension polymerization was carried out in the same aqueous medium as in Example 1 containing polyvinyl alcohol as a suspending agent.

To the resultant suspension of polymer particles was added a mixture of 77% by volume of water and 23% by volume of methanol containing sodium hydroxide in amounts of an equivalent to the vinyl acetate in the polyvinyl alcohol contained in the aqueous medium, and the resulting mixture was stirred at 70° C. for 3 hours.

The polymer particles were separated from the suspension, washed with water, and then were dispersed in an aqueous solution containing hydrochloric acid in amounts of an equivalent to the sodium hydroxide used, and washed therein to neutralize the sodium hydroxide used. After being centrifuged, the polymer particles were washed with water several times, and dried under reduced pressures, to provide a toner.

The surface hydrophobicity, triboelectric charge and amount of reversely charged toners, and electrostatic copying performance are shown in Table 3.

The surface hydrophobicity was estimated in terms of a maximum water/methanol volume ratio of an aqueous solution of methanol with which the particles got completely wetted. As the ratio becomes smaller, the hydrophilicity of the particles becomes higher. The amount of reversely charged toners was determined by means of an electric charge distribution analyzer (by Hosokawa Micron K.K., Japan). The darkness of toner images was measured at a solid dark area (3.5×3.5 cm) with a reflectometer TC-6DS (by Tokyo Denshoku K.K., Japan). The electrostatic copying performance was estimated at 20° C. and relative humidity of 40%, and otherwise in the same conditions in Example 1. This is the same with Examples 6–9 and Comparative Examples 6.

EXAMPLE 7

Sodium hydroxide was used in amounts of 50 times an equivalent to the vinyl acetate in the polyvinyl alcohol, and otherwise in the manner as in Example 6, a toner was prepared. The properties of the toner are shown in Table 3.

EXAMPLE 8

In the same manner as in Example 6, the suspension polymerization was carried out in the same aqueous medium containing polyvinyl alcohol as a suspending agent.

The polymer particles were separated and washed with water/methanol (90/10 volume ratio). A 20% by weight aqueous nitric solution was added in amounts of 20 parts by weight per part of the particles to the particles, and the dispersion was stirred at 10° C. for 3 hours. Then the polymer particles were washed with water/methanol (90/10 volume ratio) and dried under reduced pressures, to provide a toner.

The properties and electrostatic copying performance of the toner are shown in Table 3.

EXAMPLE 9

An amount of 20 parts by weight of 50% by weight aqueous nitric solution was used per part of the particles, and otherwise in the same manner as in Example 7, a toner was obtained. The propertis of the toner measured in the same manner as in Example 7 are shown in Table 3.

COMPARATIVE EXAMPLE 6

In the same manner as in Example 6, suspension polymerization was carried out in the same aqueous medium containing polyvinyl alcohol as a suspending agent.

TABLE 3

| | Examples | | | | | Comparative Examples | |
|---|---|---|---|---|---|---|---|
| | 3 | 6 | 7 | 8 | 9 | 4 | 6 |
| Properties of toner | | | | | | | |
| Surface hydrophobicity | 80/20 | 75/25 | 65/35 | — | — | 80/20 | 75/25 |
| Electric charge (μC/g) | −17.2 | −20 | −32 | −27 | −30 | −17.1 | −26 |
| Reversely charged particles (%)* | 18.5 | 7.9 | 4.4 | 6.2 | 4.2 | 27.3 | 11 |
| Copying performance | | | | | | | |
| Fog | Some | Slightly | Slightly | Slightly | Slightly | Much | Slightly |
| Darkness of toner image | 1.4 | 1.3 | 1.2 | 1.3 | 1.2 | 0.7 | 1.0 |

Notes:
*% by weight

The resultant polymer particles were recovered from the suspension, and washed with water. A solution composed of 30 parts by volume of ethanol and 70 parts by volume of deionized water and containing therein 1 part by weight of γ-chloropropyltrimethoxysilane was added to 30 parts by weight of the polymer particles, and the mixture was stirred at room temperatures for 15 minutes.

After being centrifuged, the particles were dried at 40° C. for 10 hours under reduced pressures, washed with ethanol/deionized water (30/70 in volume ratios) to remove the unreacted silane, and then again dried at 40° C. for 10 hours under reduced pressures, to provide a toner.

The properties of the toner are shown in Table 3.

What is claimed is:

1. A process for producing toners for use in electrophotography which comprises: stirring a mixture of a radical polymerizable liquid monomer and carbon black in the presence of a peroxide polymerization initiator, thereby to disperse the carbon black uniformly and minutely in the monomer; adding an azobisnitrile polymerization initiator to the resulting monomer composition; suspension polymerizing the monomer in an aqueous medium; and recovering and drying the resultant spherical polymer particles.

2. The process as claimed in claim 1, wherein the peroxide polymerization initiator is lauroyl peroxide.

3. The process as claimed in claim 1, wherein the peroxide polymerization initiator is benzoyl peroxide.

4. The process as claimed in claim 1, wherein the azobisnitrile polymerization initiator is azobisdimethylvaleronitrile.

5. A process for producing toners for use in electrophotography which comprises: stirring a mixture of a radical polymerizable liquid monomer and carbon black in the presence of a peroxide polymerization initiator, thereby to disperse the carbon black uniformly and minutely in the monomer; adding a charge controlling agent powder to the monomer composition and stirring the mixture; adding an azobisnitrile plymerization initiator to the monomer composition; suspension polymerizing the monomer in an aqueous medium; and recovering and drying the resultant spherical polymer particles.

6. The process as claimed in claim 5, wherein the peroxide polymerization initiator is lauroyl peroxide.

7. The process as claimed in claim 5, wherein the peroxide polymerization initiator is benzoyl peroxide.

8. The process as claimed in claim 5, wherein the azobisnitrile polymerization initiator is azobisdimethylvaleronitrile.

9. A process for producing toners for use in electrophotography which comprises: forming a mixture of a radical polymerizable monomer and carbon black dispersed therein; suspension polymerizing the monomer in an aqueous medium which contains polyvinyl alcohol as a suspending agent; saponifying the polyvinyl alcohol remaining on the resultant spherical polymer particles; and recovering and drying the spherical polymer particles.

10. The process as claimed in claim 9, wherein the saponifying is carried out in the presence of an acid or an alkali.

11. The process as claimed in claim 9, wherein the mixture of a radical polymerizable monomer and carbon black dispersed therein is formed by stirring the mixture of the monomer and the carbon black in the presence of a peroxide polymerization initiator.

12. The process as claimed in claim 11, wherein the peroxide polymerization initiator is lauroyl peroxide.

13. A process for producing toners for use in electrophography which comprises:

(a) a step of stirring a mixture of a radical polymerizable liquid monomer and carbon black in the presence of a peroxide polymerization initiator, thereby to disperse the carbon black minutely and uniformly in the monomer;

(b) a step of mixing the resultant mixture with a charge controlling agent powder and stirring the mixture, thereby to disperse the powder minutely and uniformly in the monomer;

(c) adding an azobisnitrile polymerization initiator to the resultant monomer composition, suspending the monomer composition in an aqueous medium which contains polyvinyl alcohol as a suspending agent, and polymerizing the monomer;

(d) saponifying the polyvinyl alcohol remaining on the resultant spherical polymer particles; and (e) recovering the particles and drying the same.

14. The process as claimed in claim 13, wherein the saponifying is carried out in the presence of an acid or an alkali.

15. A process for producing toners for use in developing electrostatic latent images which comprises: forming a mixture of a radical polymerizable monomer and carbon black; suspension polymerizing the monomer in an aqueous medium which contains polyvinyl alcohol as a suspending agent; suspension polymerizing the monomer in an aqueous medium which contains polyvinyl alcohol as a suspending agent; nitrating the polyvinyl alcohol remaining on the resultant spherical polymer particles; and recovering and drying the spherical polymer particles.

16. The process as claimed in claim 15, wherein the nitration agent is an aqueous nitric acid solution, an aqueous solution of a mixture of nitric acid and sulfuric acid, or an aqueous solution of a mixture of nitric acid and anhydrous acetic acid.

17. A process for producing toners for use in developing electrostatic latent images which comprises:

(a) a step of stirring a mixture of a radial polymerizable liquid monomer and carbon black in the presence of a peroxide polymerization initiator, thereby to disperse the carbon black minutely and uniformly in the monomer;

(b) a step of mixing the resultant mixture with a charge controlling agent powder and stirring the mixture, thereby to disperse the powder minutely and uniformly in the monomer;

(c) adding an azobisnitrile polymerization initiator to the resultant monomer composition, suspending the composition in aqueous medium which contains polyvinyl alcohol as a suspending agent, and polymerizing the monomer;

(d) nitrating the polyvinyl alcohol remaining on the resultant spherical polymer particles with an aqueous nitrating agent; and (e) recovering the particles and drying the same.

18. The process as claimed in claim 17, wherein the nitration agent is an aqueous nitric acid solution, an aqueous solution of a mixture of nitric acid and sulfuric acid, or an aqueous solution of a mixture of nitric acid and anhydrous acetic acid.

* * * * *